United States Patent [19]

Miller

[11] 4,304,985

[45] Dec. 8, 1981

[54] DEVELOPER FOR DRY SILVER PAPER

[75] Inventor: William H. Miller, Indianapolis, Ind.

[73] Assignee: The United States of America as represented by the Secretary of the Navy, Washington, D.C.

[21] Appl. No.: 153,114

[22] Filed: May 27, 1980

[51] Int. Cl.[3] ..... H05B 1/02

[52] U.S. Cl. ..... 219/216; 219/338; 219/469; 34/110; 355/3 DR

[58] Field of Search ..... 219/216, 244, 388, 530, 219/540, 469, 470, 471, 528, 543, 552; 34/110; 338/308, 309; 118/60; 250/65; 354/297; 427/11; 95/75, 94; 355/115, 3 DR, 3 R

[56] References Cited

U.S. PATENT DOCUMENTS

| | | | |
|---|---|---|---|
| 3,079,272 | 2/1963 | Greig | 130/620 |
| 3,086,100 | 4/1963 | Carrozza et al. | 219/244 |
| 3,105,133 | 9/1963 | Norton | 219/244 X |
| 3,177,793 | 4/1965 | Stewart | 95/94 |
| 3,202,818 | 8/1965 | Thomiszer | 219/216 X |
| 3,211,074 | 10/1965 | Heiart et al. | 95/75 |
| 3,249,738 | 5/1966 | Simm et al. | 219/216 |
| 3,333,088 | 7/1967 | Verbeek | 219/471 |
| 3,467,470 | 9/1969 | Donnelly, Jr. et al. | 355/115 |
| 3,469,077 | 9/1969 | Petersen et al. | 219/469 |
| 3,471,683 | 10/1969 | Bogue | 219/469 |
| 3,561,133 | 2/1971 | Hauck | 34/110 |
| 3,621,201 | 11/1971 | Crane et al. | 219/388 |
| 3,725,639 | 4/1973 | Seil et al. | 219/216 |
| 3,864,709 | 2/1975 | Bruns | 219/216 X |
| 3,948,215 | 4/1976 | Namiki | 118/60 |
| 4,065,585 | 12/1977 | Jelfo et al. | 427/11 |
| 4,112,280 | 9/1978 | Salsich | 219/216 |
| 4,243,869 | 1/1981 | Scribner | 219/216 |

*Primary Examiner*—Volodymyr Y. Mayewsky

[57] ABSTRACT

A thermal processing device for dry photographic paper using a minimum amount of electrical energy. A cylindrical drum is provided with heating elements on the inside surface and current is applied through a slip ring assembly. A non-metallic belt, substantially equal in width to the length of the cylindrical drum, is supported by rollers so that a portion of the belt engages the cylindrical drum. Rotation of the cylindrical drum causes rotation of the belt and a sheet of paper fed into the device is sandwiched between the belt and drum and is heated thereby to develop the dry photographic paper.

1 Claim, 3 Drawing Figures

DEVELOPER FOR DRY SILVER PAPER

BACKGROUND OF THE INVENTION

The present invention relates to a thermal processor for photographic paper and more particularly to an improved heating apparatus for processing dry photographic paper.

Various imaging materials are known which utilize heat development following an imagewise exposure, e.g., by electrical charge, light or other forms of electromagnetic radiation; and many different devices have been utilized for thermally processing such materials. Common requirements for such devices are a well and uniform application of heat, a rapid and efficient heat transfer to minimize energy usage and a reliable feed means which obviates material jams and conserves the power required for material transport.

Various approaches have been utilized, e.g., hot air heating, infrared heating, microwave heating, etc.; however, a simple and common approach has been conductive heating by moving sheet or web to be developed in intimate contact with a heated member. One common configuration for implementing the last mentioned approach utilizes a rotating heated drum, on which the sheet or web is moved from an entrance zone to an exit zone around the drum periphery. To maintain the sheet in intimate contact with the drum during rotation along the development path, a stationary support, e.g., a belt, or blanket, or shoe, has been located around the drum periphery, usually spring-biased into contact with the rotating drum. These processors often rely on the friction force between the drum and copy material, which is higher than the friction force between the copy material and stationary support, to effect transport of the copy material through the processing zone. Another, somewhat similar, kind of apparatus utilizes a stationary heated member, (e.g., drum or platen) over which a continuous belt is moved to transport the copy material and hold it in close contact with the heated member. In this latter configuration the frictional force between the moving belt and copy material is greater than between the stationary heated member and sheet.

SUMMARY OF THE INVENTION

The present invention relates to a thermal processor for photographic paper and requires only a small amount of power so that it can be used where power is limited, such as in a space shuttle, or other airborne operations. A cylindrical heater drum is provided with heating elements on the inside and current is supplied through a slip ring assembly as the drum is rotated by a drive assembly. A non-metallic belt, which is substantially the same width as the length of the cylindrical drum, is supported by idler rollers and a portion of the belt egages the cylindrical drum and is rotated therewith. When photographic paper is fed into the processor, the roller action of the drum and belt draw the paper into the processor and the paper is sandwiched between the drum and belt and is heated by by the drum. The speed of rotation of the drum and its temperature are regulated so that the paper is heated the proper amount to cause chemical development of the photographic paper.

It is therefore a general object of the present invention to provide a low-power processor for developing heat-sensitive paper, such as dry silver paper.

Another object of the present invention is to provide a thermal processor for heat-sensitive paper which will operate in a zero gravity environment.

Other objects, advantages and novel features of the present invention will become apparent from the following detailed description of the invention when considered in conjunction with the accompanying drawings.

DESCRIPTION OF THE PREFERRED EMBODIMENT

Figure 1:
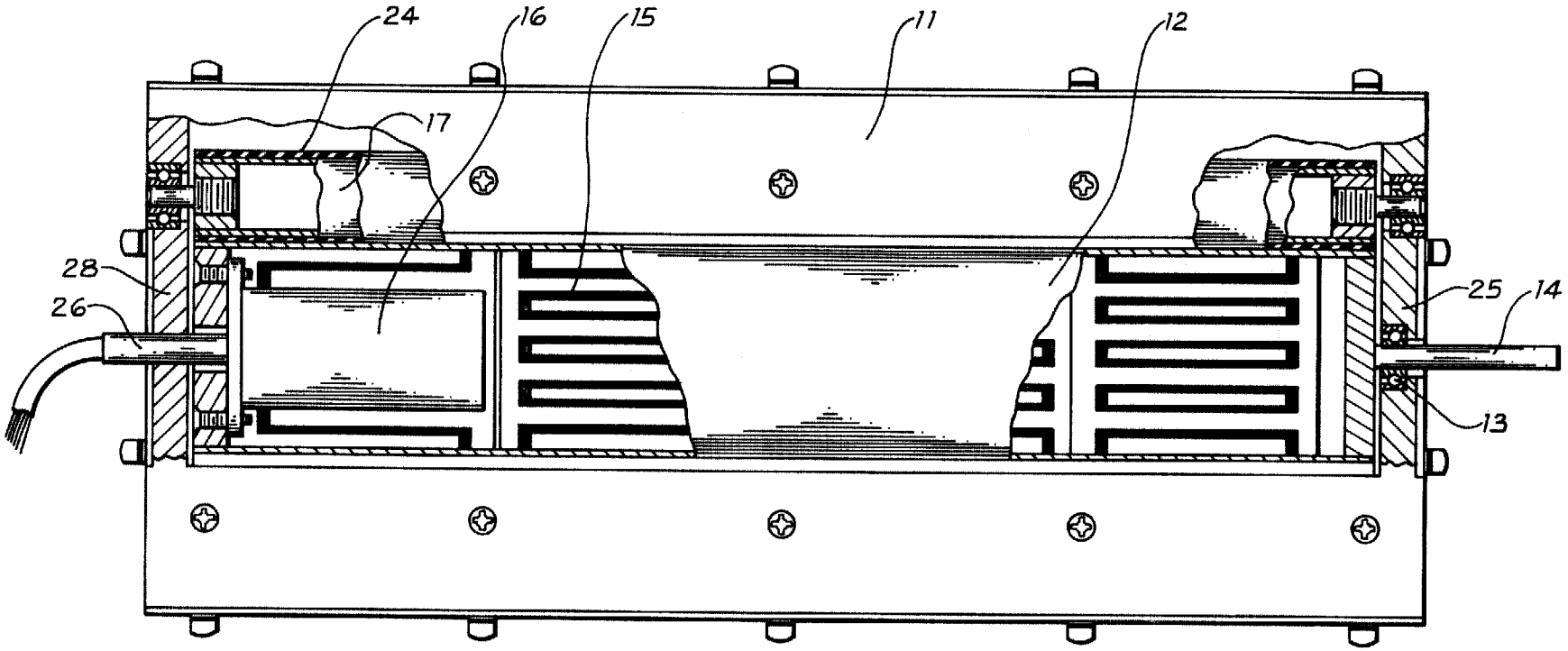
FIG. 1 is a front view, partially broken away, of a preferred embodiment.
Figure 2:
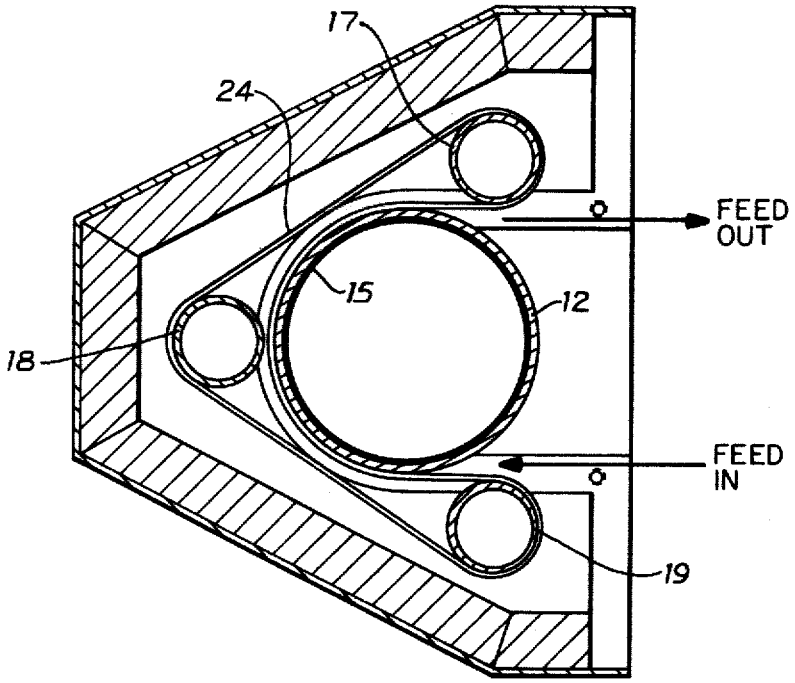
FIG. 2 is a sectional view taken on line 2—2 of FIG. 1.

Referring now to the drawing, there is shown a developer for dry silver paper having a housing 11 in which a cylindrical heating drum 12 is rotatably mounted. By way of example, drum 12 might be made of copper in order to provide good heat distribution and the outer periphery of drum 12 is provided with a highly polished nickel-plated surface for contact with photographic paper. Rotation of drum 12 is accomplished through shaft 14 which is connected to a drive source (not shown). Heating elements 15 are provided on the inside of drum 12 and, by way of example, might be of laminated, etched foil. By way of example, heating element 15 might be made of non-inductive heating elements positioned between layers of polimide insulating material and one source of such an assembly is Minco Products, Inc., Minneapolis, Minn., 55432, which manufactures Thermofoil Heaters. Current is applied to heating elements 15 through a slip ring assembly 16 which, by way of example might be model CAY-110, which is made by Airflyte Electronics Co., Bayonne, N.J. As best shown in FIG. 1 of the drawings, the end of drum 12 near shaft 14 is supported by bearing 13 which is mounted in end plate 25 and the opposite end of drum 12 is supported by slip ring assembly 16 which has a stationary shaft 26 supported by end plate 28. Slip ring assembly 16 is provided with ball bearings so that its housing assembly can rotate relative to shaft 26.

Figure 3:
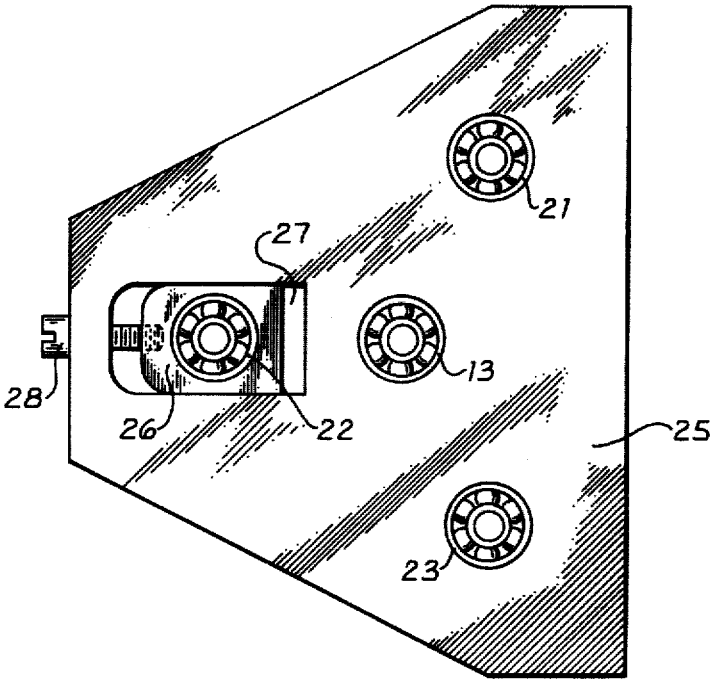
FIG. 3 is a plan view of a side bearing plate.

Three idler rollers 17, 18 and 19 are positioned about drum 12 and are rotatably mounted in bearings 21, 22, and 23, respectively, and rollers 17, 18, and 19 are substantially equal in length to the length of drum 12. An endless belt 24 is supported by these idler rollers, with belt 24 engaging about one-half the circumference of drum 12. As best shown in FIG. 3 of the drawings, bearings 21 and 23 are located in fixed positions in end plate 25 and bearing 22 is mounted in holder 26 which slides in slot 27 in end plate 25. An adjusting screw 28 is threadedly engaged with holder 26 to adjust the tension of belt 24. Belt 24 is preferably a continuous belt woven from Nomex yarn which has been impregnated with silicon rubber and is designed to withstand an operating temperature of 300 degrees F. Belt 24 is substantially equal in width to the length of drum 12 and the rotation of drum 12 and belt 24 provide a "pinch-roller" action to sandwich and move photographic paper between belt 24 and the heated drum 12.

OPERATION

It has been determined that about 50 watts are needed to develop an 8.5 × 10 inches of dry silver photographic paper and as there is some heat loss from drum 12, about 100 watts of power are supplied to heating elements 15 through slip ring assembly 16. Developing of dry silver photographic paper has a time-temperature relationship and, at a temperature of about 250 degrees, a time of about ten seconds is needed for development. The time that photographic paper is being heated is dependent on the speed of drum 12 and a drum turning at a speed of 3 revolutions would subject the paper to about 10 seconds of heating.

Before feeding in paper, power is applied to heating elements 15, and rum 12 is brought up to a temperature of about 250 degrees F. When a sheet of paper is to be developed, the paper is fed into the developer assembly and the pinch roller action of drum 12 and belt 24 grab the paper and move it about 180 degrees about the drum 12. During this movement, the paper is being heated by drum 12 thereby causing development of the photographic paper. After traveling about 180 degrees, the belt peels away from drum 12 and the photographic paper exits from the developer.

Obviously many modifications and variations of the present invention are possible in the light of the above teachings. It is therefore to be understood that the invention may be practiced otherwise than as specifically described.

I claim:

1. A developer for dry silver photographic paper comprising, a housing, a hollow metallic cylindrical roller, heating elements positioned on the inside surface of said hollow metallic cylinder, bearing means in said housing for rotatably supporting a first end of said hollow metallic cylindrical roller, a slip ring assembly positioned inside said hollow metallic cylindrical roller for rotatably supporting a second end of said hollow metallic cylindrical roller and for connecting current with said heating elements, drive means coupled to said hollow metallic cylinder, a non-metallic belt substantially equal in width to the length of said hollow metallic cylinder roller, and at least three cylindrical support rollers supporting said belt in engagement with a portion of said hollow metallic cylindrical roller whereby rotation of said hollow metallic cylindrical roller causes movement of said belt to move a sheet of photographic paper between said belt and said hollow metallic cylindrical roller whereby said sheet of photographic paper is heated.

* * * * *